United States Patent [19]

Snedeker

[11] Patent Number: 4,683,800

[45] Date of Patent: Aug. 4, 1987

[54] MODULAR ARMOR

[75] Inventor: Richard S. Snedeker, Cranbury, N.J.

[73] Assignee: Aeronatical Research Associates of Princeton, Inc., N.J.

[21] Appl. No.: 802,190

[22] Filed: Nov. 25, 1985

[51] Int. Cl.[4] ..... F41H 5/16

[52] U.S. Cl. ..... 89/36.02; 89/36.04; 428/911

[58] Field of Search ..... 428/49, 911, 45, 48, 428/53, 60; 404/41; 52/608, 609; 89/36.02, 36.04

[56] References Cited

U.S. PATENT DOCUMENTS 3,616,115 10/1971 Klimmek ..... 428/189 X

FOREIGN PATENT DOCUMENTS 2543287 4/1977 Fed. Rep. of Germany ..... 404/41
345451 5/1960 Switzerland ..... 404/41
410404 5/1934 United Kingdom ..... 404/41

*Primary Examiner*—Peter A. Nelson
*Attorney, Agent, or Firm*—Larson and Taylor

[57] ABSTRACT

A modular armor includes a matrix of interfitted elements which forms a self-supporting layer. Each element has a first rectangular parallelepiped leaf having a length substantially twice the width. The element further includes a second rectangular parallelepiped leaf having the same width and length as the first leaf and which is suitably attached as by integral formation with the first leaf to form a cruciform. The elements in the matrix are suitably held together to form the modular armor. In one embodiment, the leaves of one element are provided with pockets in which ceramic blocks are located. Additional leaves can also be provided with each element to further strengthen the element and to hold the matrix together. Each of the elements can be joined to one another to hold the elements together, or a frame could be provided for the elements. If the armor is desired to cover a complex curvature, the overlapping portions of the leaves can be provided with a convex surface to allow the matrix of elements to follow the complex curvature. A diagonal tongue and groove system is also disclosed for holding the elements together as well as a system of locking projections and indentations.

54 Claims, 17 Drawing Figures

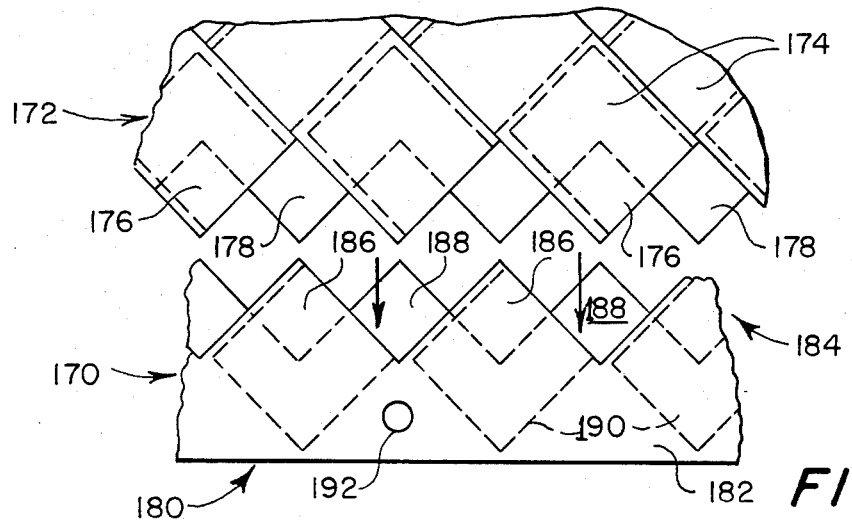
FIG. 10
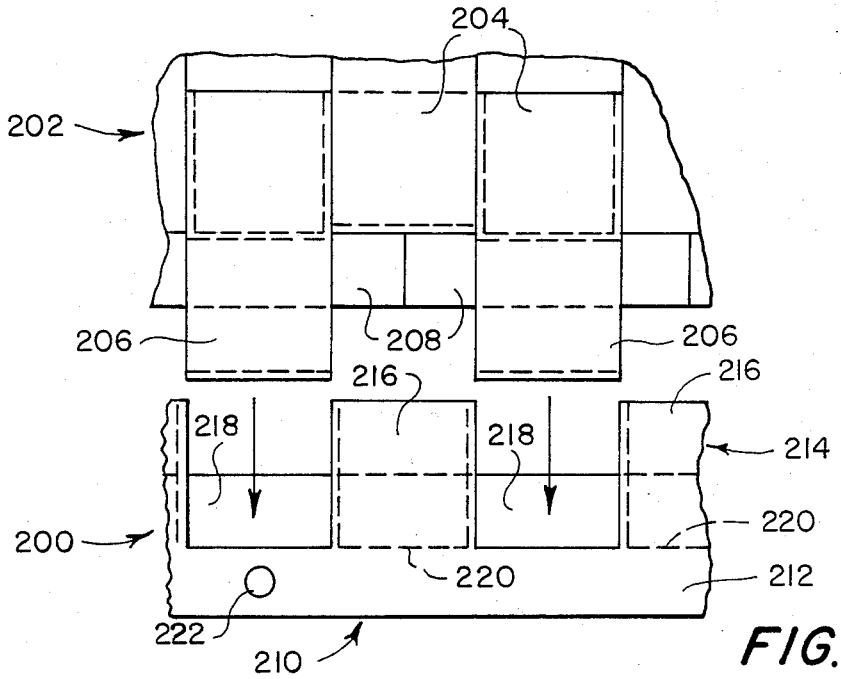
FIG. 11
FIG. 12
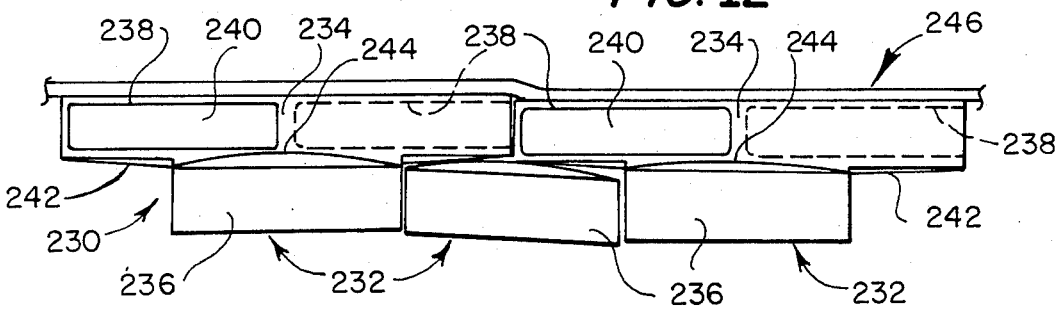

MODULAR ARMOR

FIELD OF THE INVENTION

The present invention relates generally to ballistic armor, and more particularly to a modular armor made from a plurality of interfitted elements.

BACKGROUND OF THE INVENTION

There have been a number of composite armors disclosed in the prior art. For example, in U.S. Pat. No. 4,534,266 (Huet), a composite armor plating including ceramic inserts arranged in a regular manner within a metal casting is disclosed. Each of the inserts is encased within a shell, and each shell has male and female portions which are received in the male and female portion of adjacent inserts to maintain the inserts in a regular pattern during casting.

Various composite armors containing a ceramic or similar material are also disclosed in the following U.S. Pat. Nos. 4,198,454 (Norton); U.S. Pat. No. 3,616,115 (Klimmek); U.S. Pat. No. 3,705,558 (McDougal et al) and U.S. Pat. No. 4,179,979 (Cook et al). A composite armor containing ceramic tiles mounted on a plurality of fiberous layers is also disclosed in U.S. Pat. No. 3,444,033 (King).

While armors of the above type may function satisfactorily, any damage to such an armor requires wholesale replacement or makeshift repairing. In addition, for contoured surfaces or complexed shaped surfaces, customized armor must be produced.

SUMMARY OF THE INVENTION

The present invention is a modular armor which comprises a plurality of interfitted elements which form a self-supporting layer. Each element includes a first rectangular leaf having a length substantially twice the width and a second rectangular leaf substantially the same size as the first leaf. The first and second leaves are attached together in a cruciform pattern. A suitable means is then provided for holding a plurality of the elements together as a unit. Preferably, the longitudinal axes of the two leaves are perpendicular to one another and the two leaves are integrally formed.

In one embodiment of the present invention, a pair of substantially square pockets are formed in one of the leaves. In these pockets, square blocks which are made of a ceramic material are provided. According to the preferred embodiment, one pocket is formed in an end of the leaf and the other pocket is an opening through one of the sides of the leaf. With this construction, the greatest area of continuously separated ceramic blocks is provided. In accordance with the present invention, both leaves can be provided with a pair of ceramic blocks to double the number of layers of ceramic blocks provided.

In another embodiment of the present invention, a first leaf containing ceramic blocks is sandwiched between a second leaf and a third leaf. The longitudinal axes of the second and third leaves are parallel to one another and perpendicular to the longitudinal axis of the first leaf. Preferably, all three leaves are made integral with one another. In order to hold the plurality of leaves together, a weld is conveniently provided between adjacent elements along the second and third leaves. Alternatively, a lock means is provided for releaseably locking one element to an adjacent element. Such a lock means can take the form of a lock projection on the facing surfaces of the second and third elements, and a corresponding indentation on the end portions of the first leaf received therebetween. Alternatively, the friction fit between the interfitted elements may be sufficient to hold the interfitted elements together. It should also be appreciated that similar lock means can be provided for the embodiment of the elements containing only two leaves.

Alternative means for holding the interfitted elements together include a continuous layer to which the various elements are attached. Either all of the elements, or selected spaced elements are attached to this continuous layer. Another means for holding the various elements together is to provide a bonding material between overlapping surfaces of the leaves of the various elements. A weld can also be provided between adjacent leaves.

Still another means for holding the interfitted elements together is a frame member. Preferably, the sides of the frame contain an interior portion which is configured to interfit with an outer row of the interfitted elements. In one embodiment of the frame, the longitudinal axis of the side is parallel to the longitudinal axis of one of the leaves of the element. Alternatively, the longitudinal axis of the side receives the interfitted row of elements at an angle of 45° to the longitudinal axis of the one of the leaves. The sides of the frames are then suitably attached to the structure to be protected.

In order to provide protection for a curved surface, the overlapping surface portions of the leaves are provided with a convex shape. This allows the matrix of interfitted elements to bend slightly to accommodate a curved surface. Conveniently, with this embodiment of the present invention, the various interfitted elements are attached to a flexible layer of a suitable material.

In still another embodiment of the present invention, each element includes a plurality of leaves with each leaf being perpendicular to an adjacent leaf. With such an embodiment, the elements can be held to one another by a localized deformation of interfitted leaves.

In yet another embodiment of the present invention, the elements can be held together using a tongue and groove means for interfitting one element with adjacent elements. Preferably, the tongue and groove means include a V shaped tongue provided at each end of one leaf and a respective corresponding V shaped groove provided at each end of the other leaf.

It is a feature of the present invention that the matrix of interfitted elements are inherently self-supporting.

It is also a feature of the present invention that a layer of ceramic blocks can be provided in the matrix of interfitting elements.

It is another feature of the present invention that the modular armor is discontinuous so that only localized damage occurs. In addition, by being discontinuous, the armor serves as a poor shock transmission material.

Still another feature of the present invention is a capability to control the failure of the matrix of elements when the elements are individually joined to one another.

It is an advantage of the present invention that the modular armor is suitable for use as both a structural armor and as an appliqué.

It is another feature of the present invention that any size of armor desired can be built up as a matrix of elements.

It is a further advantage of the present invention that the modular armor inherently limits collateral damage.

Still another advantage of the present invention is that all the matrix elements are identical. Thus, all of the elements can be easily mass produced at a low cost.

Yet another advantage of the present invention is that damaged elements are easily replaceable, even under adverse conditions such as occur in the field.

Still another advantage of the present invention is that complex shapes can be fitted with the modular armor of the present invention.

Other features and advantages of the present invention are stated in or apparent from a detailed description of presently preferred embodiments of the invention found hereinbelow.

BRIEF DESCRIPTION OF THE DRAWINGS

FIG. 10 is a plan view of a portion of a side of a suitable holding frame and an associated matrix of elements prior to joining.

FIG. 11 is a plan view of an alternative portion of a holding frame and an associated matrix of elements prior to joining.

FIG. 12 is an elevation view of still another embodiment of matrix elements joined together by a flexible layer of material.

DETAILED DESCRIPTION OF THE PREFERRED EMBODIMENTS

Figure 1:
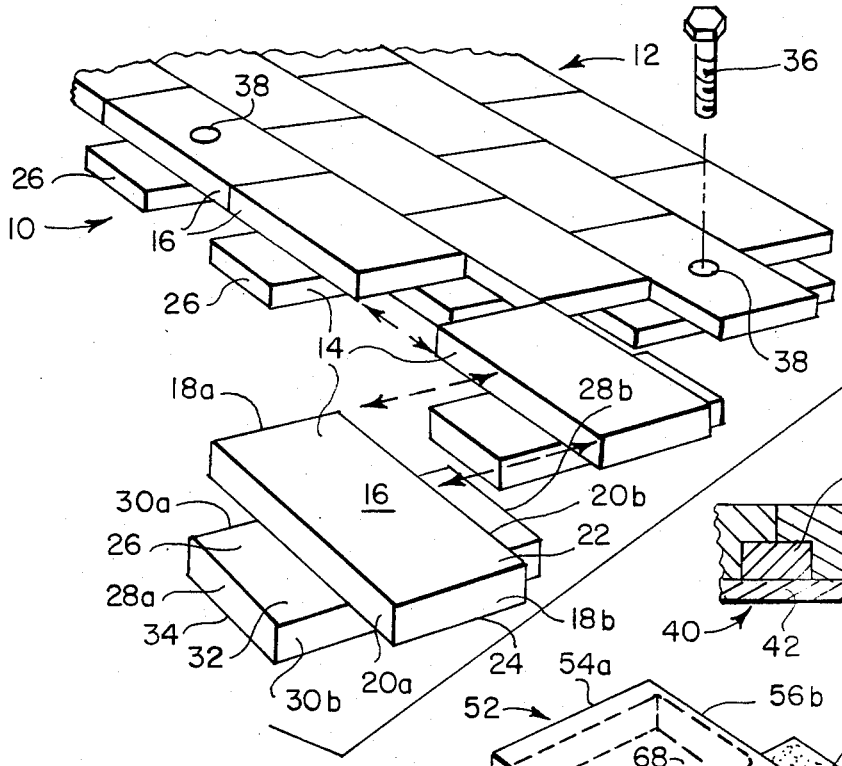
FIG. 1 is a perspective view of a matrix of interfitted elements according to the present invention.

With reference now to the drawings in which like numerals represent like elements throughout the several views, a composite armor 10 which is constructed of a matrix 12 of interfitted elements 14 is depicted in FIG. 1. As shown, each element 14 includes a first rectangular parallelepiped leaf 16 having ends 18*a* and 18*b*, sides 20*a* and 20*b*, a top 22, and a bottom 24. Element 14 also includes a second rectangular parallelepiped leaf 26 having ends 28*a* and 28*b*, sides 30*a* and 30*b*, a top 32, and a bottom 34. Both the length and width of first leaf 16 and second leaf 26 are the same, although the thickness of leaves 16 and 26 can be different. In addition, the width of each leaf 16 and 26 is preferaby one-half of the length.

Each element 14 includes a means for attaching bottom 24 of first leaf 16 to top 32 of second leaf 26. In the preferred embodiment of the present invention, the attaching means is the making of element 14 integral. This is conveniently provided by an integral casting process although machining from a solid block is also possible. Alternatively, first leaf 16 can be attached to second leaf 26 by suitable bolts in order to provide an easy means for disassemblying first leaf 16 from second leaf 26 and hence for removing and replacing each element 14 from matrix 12.

In the preferred embodiment, each element 14 is a cruciform shape with first leaf 16 perpendicular to second leaf 26. In addition, first leaf 16 is located in the center of top 32 of second leaf 26 intermediate ends 28*a* and 28*b* of second leaf 26. Similarly, second leaf 26 is located in the center of bottom 24 of first leaf 16 intermediate ends 18*a* and 18*b* of first leaf 16. With this construction of elements 14, matrix 12 is suitably built up to any desired size or approximate shape by assembling elements 14 as indicated in FIG. 1.

Once matrix 12 is constructed, it should also be appreciated that matrix 12 is then inherently self-supporting. Modular armor 10 is thus suitable for use as both a structural armor and as an appliqué. In addition, by being made of a plurality of elements 14, modular armor 10 inherently limits any collateral damage from one element 14 to the other. Furthermore, should any element 14 be damaged, as all elements 14 are identical, a suitable substitute element 14 can be easily substituted in matrix 12 for any damaged element 14.

Conveniently, modular armor 10 is attached to an underlying structure by use of a bolt 36 which passes through an aperture 38 provided in one of elements 14. As matrix 12 is inherently self-supporting, it should be appreciated that not every element 14 is required to be attached to the underlying structure so that a number of elements can be provided between each element having an attachment aperture 38.

It should also be appreciated that matrix 12 is formed by appropriately interfitting elements 14 as shown in FIG. 1. By forming the width of each leaf 16 and 26 to be one half of the length, matrix 12 forms an armor essentially equivalent to a plate having the same thickness as the thickness of each element 14. This is because there are essentially no gaps between first leaves 16 of each element 14 and between second leaves 26 of each element 14. This also provides a close friction fit to hold the various individual elements 14 together as a matrix of elements.

If friction is not sufficient to securely hold interfitted elements 14 in a matrix 12, a suitable holding means is provided. In addition to bolts 36 located in apertures 38 at various places in matrix 12, it is also possible to provide bolts 36 and apertures 38 in the peripheral elements 14 of matrix 12 to hold these elements to the underlying structure and hence to hold matrix 12 together.

Figure 2:
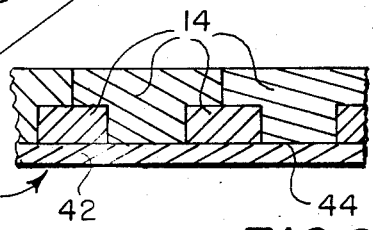
FIG. 2 is a cross-sectional elevation view of an alternative embodiment of interfitted elements according to the present invention.

Depicted in FIG. 2 is an alternative holding means 40. Holding means 40 includes a continuous layer 42 to which each element 14 is suitably attached by a layer of adhesive 44. Continuous layer 42 can be made of the same material as elements 14, or of a different material. For example, both continuous layer 42 and elements 14 can be made from metal, plastic, or the like. Alternatively, elements 14 can be made from a suitable metal and continuous layer 42 made from a different material such as plastic or a Kevlar laminate. Continuous layer 42 is then suitably attached to an underlying structure at selected locations to mount the matrix of elements 14. Where continuous layer 42 is made of a flexible material, depending on the clearances between elements 14, a somewhat flexible armor is also achieved.

Figure 3:
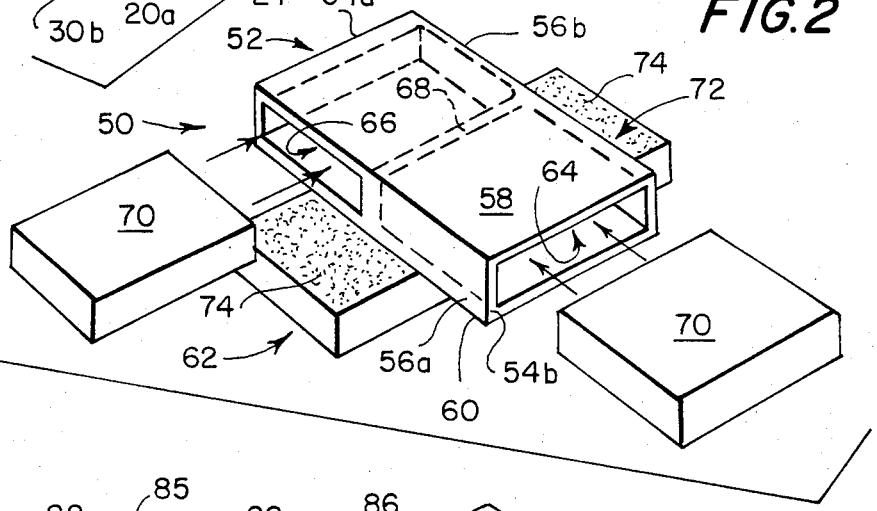
FIG. 3 is an exploded perspective view of an alternative embodiment of a matrix element.

Depicted in FIG. 3 is an alternative embodiment of an element 50 which is used similarly to element 14 to provide a matrix of interfitted elements forming a modular armor. Element 50 includes a first leaf 52 having ends 54*a* and 54*b*, sides 56*a* and 56*b*, a top 58 and a bottom 60. Securely attached to first leaf 52 is an integral second leaf 62. As shown, second leaf 62 has the same width and length as first leaf 52 which width is one half of the length. First leaf 52 and second leaf 62 form a cruciform element 50 as shown.

Provided in end 54*b* of first leaf 52 is a blind pocket 64. Blind pocket 64 entends longitudinally into first leaf 52 by a distance equal to the width of first leaf 52. Provided in side 54*a* of first leaf 52, away from end 54*a*, is a through pocket 66. Through pocket 66 extends from side 56*a* to side 56*b* so that through pocket 66 has an opening in each side 56*a* and 56*b*. Separating blind pocket 64 and through pocket 66 is a vertical wall 68. With this construction, both blind pocket 64 and through pocket 66 are provided with the same thickness, width, and length.

Also depicted in FIG. 3 are blocks 70 which are sized to fit snugly into pockets 64 and 66. Blocks 70 are preferably made of a suitable projectile resisting or ablating material such as a ceramic. Because of the construction of pockets 64 and 66, both ceramic blocks 70 are identical to one another. It should be appreciated that first leaf 52 therefore provides a mounting for two ceramic blocks 70 in a close yet spaced orientation to one another. This is desirous in order to provide relatively little space between the ceramic blocks for complete coverage while still providing for the destruction of one block without affecting the structural integrity of the other or an adjacent block.

As element 50 has the same cruciform configuration of elements 14 depicted in FIG. 1, it is apparent that a plurality of elements 50 are similarly formed into a matrix similar to matrix 12 in order to provide an alternative modular armor according to the present invention. Such a matrix of elements 50 provides a complete coverage of the underlying structure by ceramic blocks 70 except for small vertical dividing walls. These small vertical dividing walls are dividing wall 68 between blocks 70, and the vertical dividing walls between adjacent elements 50 provided by end 54*a* and the vertical walls of sides 56*a* and 56*b*. As with matrix 12, the matrix of elements 50 provides a plurality of replaceable elements which are inherently self-supporting and which limit the lateral damage upon impact of a single element 50.

Also depicted in FIG. 3 is an alternative holding means 72 for holding the matrix of elements 50 together. Holding means 72 comprises an adhesive layer 74 provided on the top portions of second leaf 62 not covered by first leaf 52. By reference to FIG. 1, it will be appreciated that the provision of adhesive layer 74 provides a bonding to a portion of two first leaves of adjacent elements which cover each adhesive layer. Thus, each element 50 is joined to four adjacent elements.

It should also be appreciated that the strength of adhesive layer 74 can be particularly designed to provide a certain strength for the joint. Thus, by design, the joint will fail upon a certain desired force, such as a predetermined impact. In this manner, collateral damage to adjacent elements is limited by the designed failure of the adhesive layer.

Figure 4:
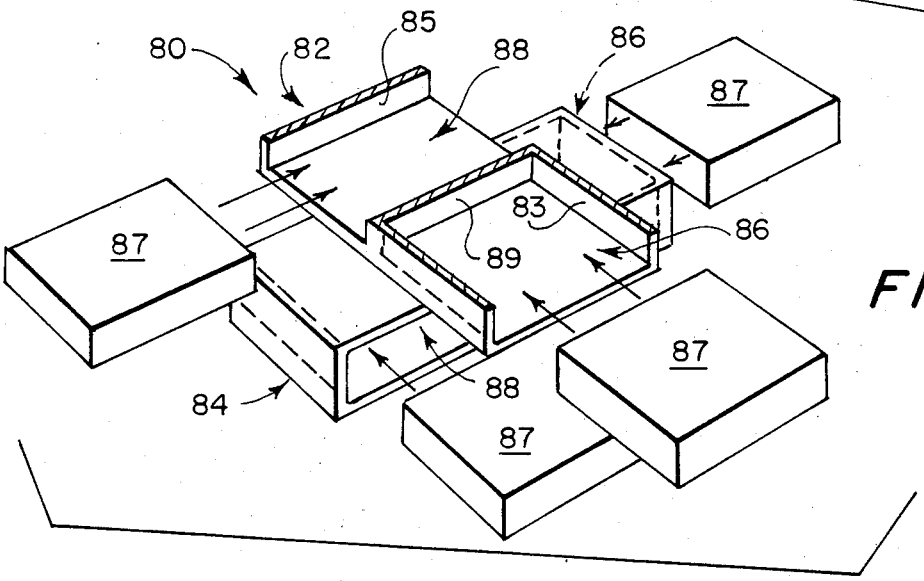
FIG. 4 is an exploded perspective view with portions cut away of another embodiment of a matrix element.

Depicted in FIG. 4 is another alternative embodiment of an interfitted element 80. Element 80 includes a first leaf 82 and a second leaf 84 with leaves 82 and 84 attached to one another to form a cruciform. Leaves 82 and 84 are similar to first leaf 52 described above in element 50. In particular, leaves 82 and 84 include, respectively, blind pockets 86 and through pockets 88. Received in pockets 86 and 88 are ceramic blocks 87. Ceramic blocks 87 are separated in leaves 82 and 84 by a vertical wall such as vertical wall 89 depicted in first leaf 82. Vertical wall 89 and an end wall 85 form sides for through pocket 88. Vertical walls 83 form sides for blind pocket 86.

By use of a plurality of elements 80 a matrix similar to matrix 12 depicted in FIG. 1 is constructed. This plurality of elements 80 provides essentially two continuous layers of ceramic blocks 87. The only areas of an underlying structure which are not covered by at least one of ceramic blocks 87 are (1) the overlapping portion or intersection of each interior vertical wall 89 of first leaf 82 and second leaf 84 in each element 80, (2) the overlapping portions or intersection of the side walls 83 of the blind pockets 86 of first leaf 82 and second leaf 84 in each element 80, and (3) the overlapping portions or intersection of end walls 85 of first leaf 82 of one element 80 and second leaf 84 of an adjacent element 80 in the matrix. If it is desired to attach the matrix consisting of elements 80 to an underlying structure, the intersection location of vertical walls 89 is a convenient position to locate a bolt 36 and an aperture 38 such as depicted in FIG. 1.

Figure 5:
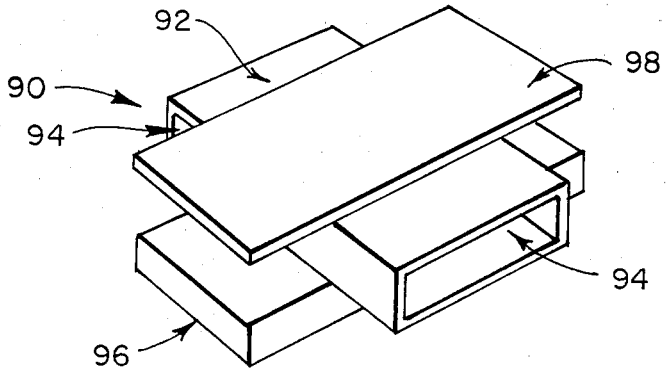
FIG. 5 is a perspective view of yet another embodiment of a matrix element.

Depicted in FIG. 5 is still another alternative embodiment of an interfitted element 90. Element 90 includes a first leaf 92 which is similar to first leaf 52 of element 50. Thus, first leaf 92 includes pockets 94 in which suitable ceramic blocks (not shown) are received. Attached to the bottom of first leaf 92 is a second leaf 96 which is similar to second leaf 62 of element 50. As with element 50, first leaf 92 and second leaf 96 of element 90 are preferably integrally formed in a cruciform.

Element 90 further includes a third leaf 98 which is attached to the top of first leaf 92 and which has a width and length dimension equal to first leaf 92. Third leaf 98 is attached to first leaf 92 so as to be parallel to second leaf 96 and to overlay second leaf 96. As with first leaf 92 and second leaf 96, third leaf 98 is also preferably integrally constructed with leaves 92 and 96.

Figure 6:
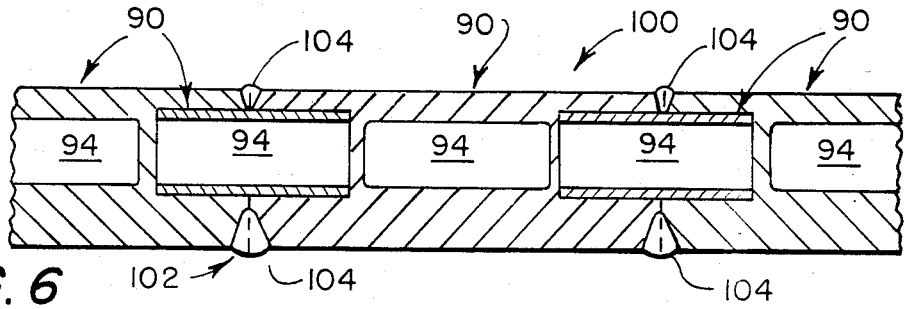
FIG. 6 is a cross-sectional elevation view of a matrix of the elements depicted in FIG. 5.

When a plurality of elements 90 are formed into a matrix 100 as depicted in FIG. 6, matrix 100 forms a self-supporting plane which includes a layer of ceramic blocks in the same manner as a matrix of elements 50 discussed above.

A suitable holding means 102 for holding matrix 100 of elements 90 together is a plurality of welds 104. Welds 104 are provided between adjacent third leaves 98 and second leaves 96 along the ends and sides thereof. By use of welds 104, matrix 100 acts similarly to a single sheet of material and is suitable for many structural applications. Alternatively, the friction fit between elements 90 may be sufficient to hold a matrix of the elements together, or the edges of the matrix may be supported to hold the matrix together.

Figure 7:
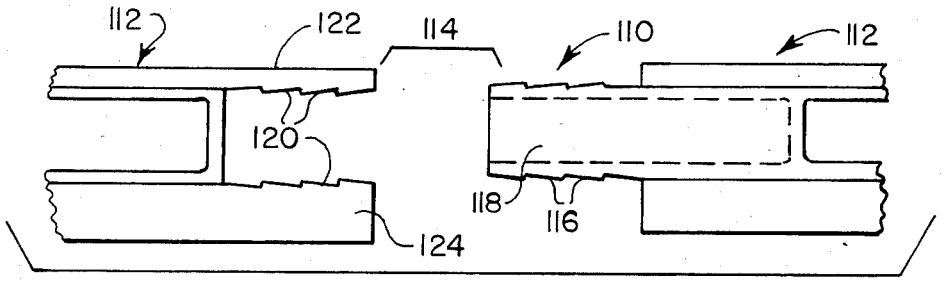
FIG. 7 is an elevation view of a locking mechanism for adjacent elements.

Depicted in FIG. 7 is an alternative holding means 110 which is used to hold elements 112 similar to elements 90 together. In this embodiment, holding means 110 includes a lock means 114 by which one element 112 is releasably locked to an adjacent element 112. As shown in FIG. 7, lock means 114 includes a plurality of lock projections 116 in the form of angled ramps on the top and bottom of a first leaf 118 of element 112. Lock means 114 further includes a plurality of lock indentations 120 which are designed to receive lock projections 116 therein. Lock indentations 120 are located on the bottom of a third leaf 122 and the top of a second leaf 124.

When two elements 112 are joined together by inserting first leaf 118 of one element 112 between third leaf 122 and second leaf 124 of one other element 112, lock projections 116 become located in lock indentations 120 to lock the two elements 112 together. Depending on the material used, the two lock elements 112 are releasable from one another with exertion of a sufficient force. By appropriate design, the strength of lock means 114 is also used advantageously to control the failure zone upon impact of a single element 112.

Figure 8:
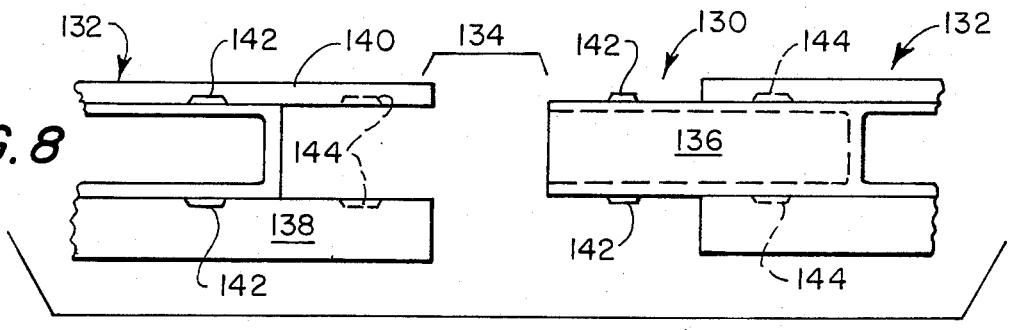
FIG. 8 is an elevation view of an alternative locking mechanism for adjacent elements.

Depicted in FIG. 8 is another embodiment of a holding means 130 for holding two elements 132 together. Holding means 130 includes a lock means 134 for locking a first leaf 136 of one element 132 between a second leaf 138 and a third leaf 140 of another element 132. As shown, lock means 134 includes a pair of opposed lock projections 116 located on first leaf 136. Corresponding lock indentations 144 are then provided in the bottom of third leaf 140 and the top of second leaf 138.

As will be appreciated, holding means 130 functions in essentially the same manner as holding means 110. However, with holding means 130, only a single lock projection and corresponding lock indentation are provided between the mating surfaces of first leaf 136 and leaves 138 and 140. Again, the separating force for lock means 134 can be specifically designed as desired.

Figure 9:
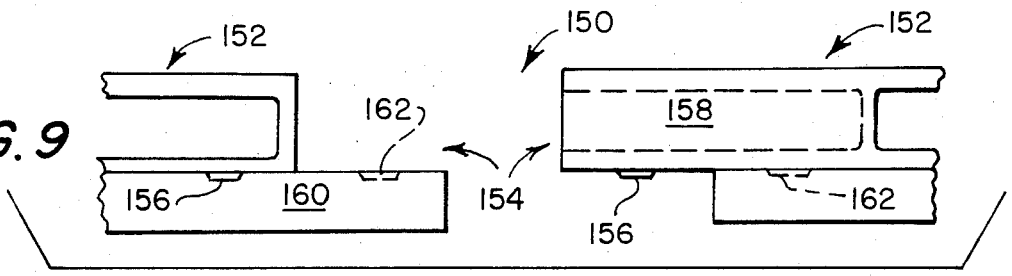
FIG. 9 is an elevation view of still another locking mechanism for adjacent elements.

Depicted in FIG. 9 is a holding means 150 which is suitable for use with elements 152. Elements 152 are similar to element 50 depicted in FIG. 3. As shown, holding means 150 includes a lock means 154 by which elements 152 are releaseably locked together. Lock means 154 includes a lock projection 156 located on the bottom surface of a first leaf 158. Located on a second leaf 160 is a lock indentation 162 in which lock projection 156 is received. By use of lock means 154, the horizontal separation of elements 152 is retarded.

Depicted in FIG. 10 is an alternative holding means 170 which is suitably used for holding a matrix 172 of elements 174. Elements 174 are depicted as being similar to element 50 depicted in FIG. 3, but without any adhesive layer 74. As depicted, elements 174 include first leaves 176 and second leaves 178. Holding means 170 is a frame 180, of which a portion of a side 182 is shown. It should be appreciated that frame 180 includes a plurality of sides which are suitably configured to contain a desired size and shape of matrix 172.

As shown in FIG. 10, side 182 includes an interior portion 184 which is configured to interfit with the row of elements 174 adjacent thereto. Thus, interior portion 184 includes upper leaves 186 which are designed to overlay the exposed top portions of second leaves 178 of elements 174. Similarly, interior portion 184 includes lower leaves 188 which are configured to project beneath the exposed portion of first leaves 176 of elements 174. With this configuration, interior portion 184 precisely interfits with elements 174 in the same manner that one row of elements 174 interfit with another row of elements 174.

In the embodiment of holding means 170 depicted in FIG. 10, elements 174 are similar to elements 50 in that elements 174 include pockets in which suitable ceramic blocks are located. In order to provide as much coverage with ceramic blocks as possible, interior portion 184 of side 182 similarly contains pockets 190 which are designed to receive a similar ceramic block. With this construction, an extra row of ceramic blocks is provided in frame 180.

Side 182 of frame 180 includes one or a plurality of apertures 192 through which suitable bolts are passed to secure side 182 to an underlying structure. In this manner, the remaining sides and hence matrix 172 is secured to the underlying structure. If desired, matrix 172 is also provided with suitable bolts and apertures such as bolts 36 and apertures 38 depicted in elements 14 in FIG. 1.

It should be appreciated that the outer row of elements 174 of matrix 172 is a diagonal row. Thus, this outer row of elements extends at a 45° angle to the longitudinal axis of first leaf 176 and second leaf 178 of each element. However, it is also possible to arrange a holding means which holds a suitable matrix along a row or column so that the longitudinal axis of the first leaf or second leaf is parallel to the row. Such a holding means 200 is depicted in FIG. 11.

Holding means 200 is used for holding a matrix 202 consisting of elements 204. It should be appreciated that elements 204 are substantially identical to elements 174 depicted in FIG. 10 and described above. Elements 204 include first leaves 206 and second leaves 208. Holding means 200 comprises a frame 210 having a plurality of sides, of which a portion of one side 212 is depicted. Side 212 includes an interior portion 214 which is configured to interfit with the outer row of elements 204 of matrix 206. For this reason, interior portion 214 includes upper leaves 216 and lower leaves 218. Preferably, upper leaves 216 also include pockets 220 in which suitable ceramic blocks or the like are received to extend the coverage of ceramic blocks located in elements 204. In order to mount side 212 to an underlying structure, an aperture 222 is also provided through which a suitable bolt or the like is passed. In this manner, the remaining sides of frame 210 are attached to an underlying structure to attach matrix 206 to the structure.

Depicted in FIG. 12 is a matrix 230 of an alternative embodiment of elements 232. Elements 232 are substantially similar to elements 50 depicted in FIG. 3. In particular, elements 232 include a first leaf 234, a second leaf 236, and pockets 238 in which suitable blocks 240 are located. However, elements 232 are specifically designed to provide matrix 230 with the ability to form a surface with a complex curvature. In order to accomplish this, bottom portions 242 of first leaf 234 which are located on either side of second leaf 236 are convex shaped. Similarly, top portions 244 of second leaf 236 are convex shaped. Because of the convex shape of portions 242 and 244, a certain amount of play is added to the interfitting of elements 232 which allows elements 232 to orient themselves in a slightly different plane from adjacent elements 232. Thus, matrix 230 is capable of conforming to surfaces having a curvature or the like.

It should be appreciated that without convex surfaces on portions 242 and 244, a matrix of elements such as matrix 12 depicted in FIG. 1 will unavoidably have a slight amount of play between the elements if the elements are not attached to one another. However, by the provision of convex portions on bottom portions 242 and top portions 244, matrix 230 can readily be designed to follow a predetermined curvature or a curvature of complex shape. Even with these convex surfaces, it should be appreciated that matrix 230 is still substantially self-supporting and the other benefits achieved by a matrix of elements discussed above are still realized.

Preferably, elements 232 of matrix 230 are attached to a suitable flexible layer 246. Conveniently, flexible layer 246 is made of a Kevlar laminate to which elements 232 are suitably bonded. For increased protection, a Kevlar laminate is provided on both sides of matrix 230. Because flexible layer 246 is flexible, flexible layer 246 does not prevent the needed movement of elements 232 to conform to a complex curvature.

Figure 13:
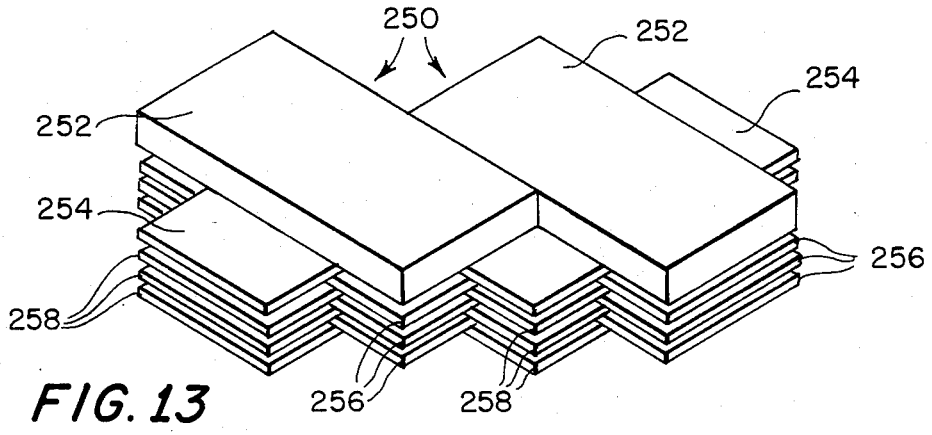
FIG. 13 is a perspective view of still another embodiment of a matrix element.
Figure 14:
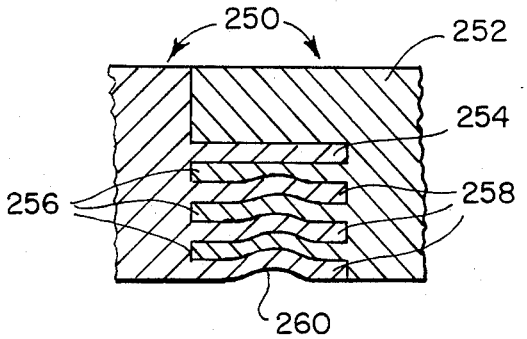
FIG. 14 is a cross-sectional elevation view of the joining of two elements depicted in FIG. 13.

Depicted in FIGS. 13 and 14 is another alternative embodiment of an interfitted element 250. Element 250 includes a first leaf 252 and a second leaf 254 which form a cruciform. In addition, element 250 further includes a plurality of third leaves 256 which are disposed parallel to first leaf 252 and which are interspaced by a plurality of fourth leaves 258 which are disposed parallel to second leaf 254. With this construction, the frictional fit between elements 250 making up a matrix is sufficient to hold these elements to an adjacent element.

If desired, bonding agents or a mechanical fastening can also be used to hold elements 250 together. Alternatively, a dimple 260 is provided in at least the lowermost third leaf 256 and fourth leaf 258 to mechanically fasten elements 250 together. As shown in FIG. 14, dimple 260 also affects other leaves 256 and 258 to increase the holding effect.

Figure 15:
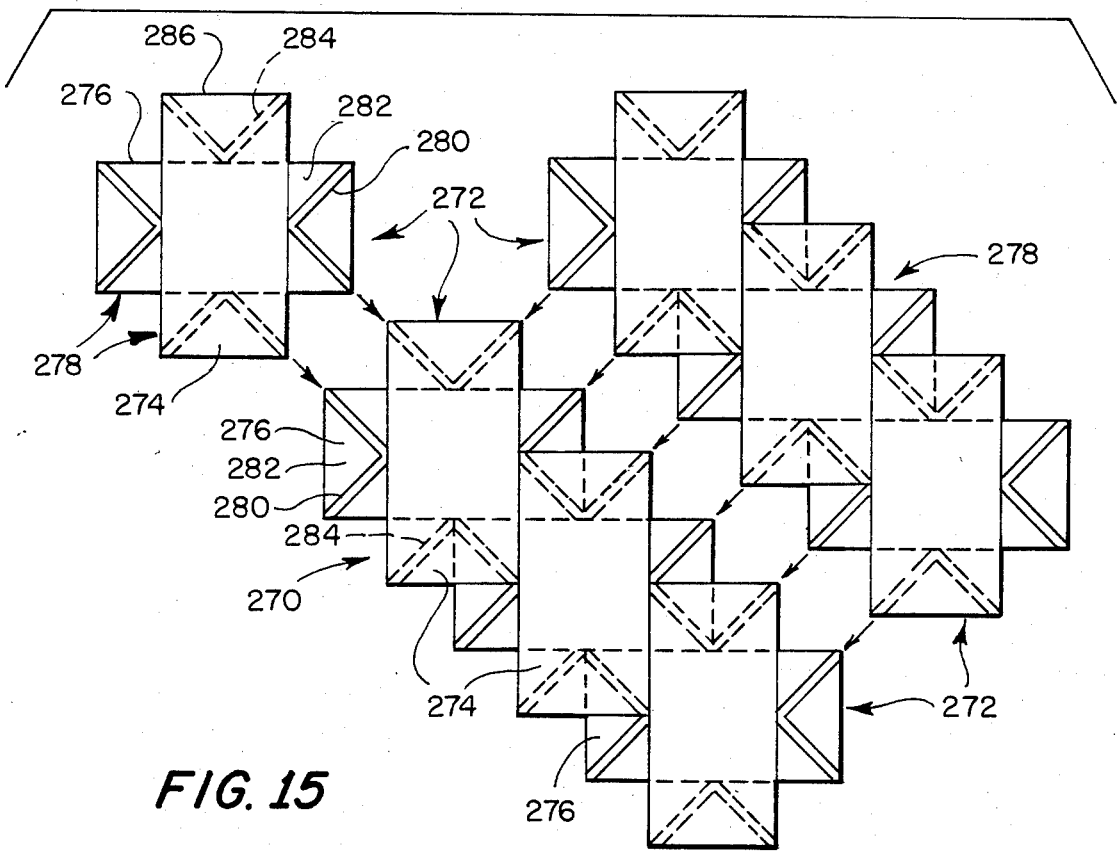
FIG. 15 is a plan view of still another embodiment of elements and the joining thereof.

Depicted in FIG. 15 is yet another alternative embodiment of a matrix 270 including elements 272. Elements 272 include first leaves 274 and second leaves 276 which are formed into a cruciform. In order to hold elements 272 together, a tongue and groove means 278 is provided on each element 272. Tongue and groove means 278 includes a V shaped tongue 280 having a V or chevron pattern in plan view provided on top portion 282 of each second leaf. A respective groove 284 having a corresponding V or chevron pattern plan view is then provided on the overlaying bottom portions 286 of each first leaf 274. It should be appreciated that tongues 280 could alternatively be located on bottom portions 286 and grooves 284 located on top portions 282.

In order to assemble elements 272 into matrix 270, an element 272 is simply moved along a diagonal of matrix 270 as depicted. The holding means such as tongue and groove means 278 is particularly adapted for a matrix which is subjected to a bending moment in order to prevent the elements from tending to slide with respect to each other along their rectilinear axes. In this manner, the entire matrix 270 is stiffened as the diagonal tongues 280 and grooves 284 prohibit this motion.

Figure 16:
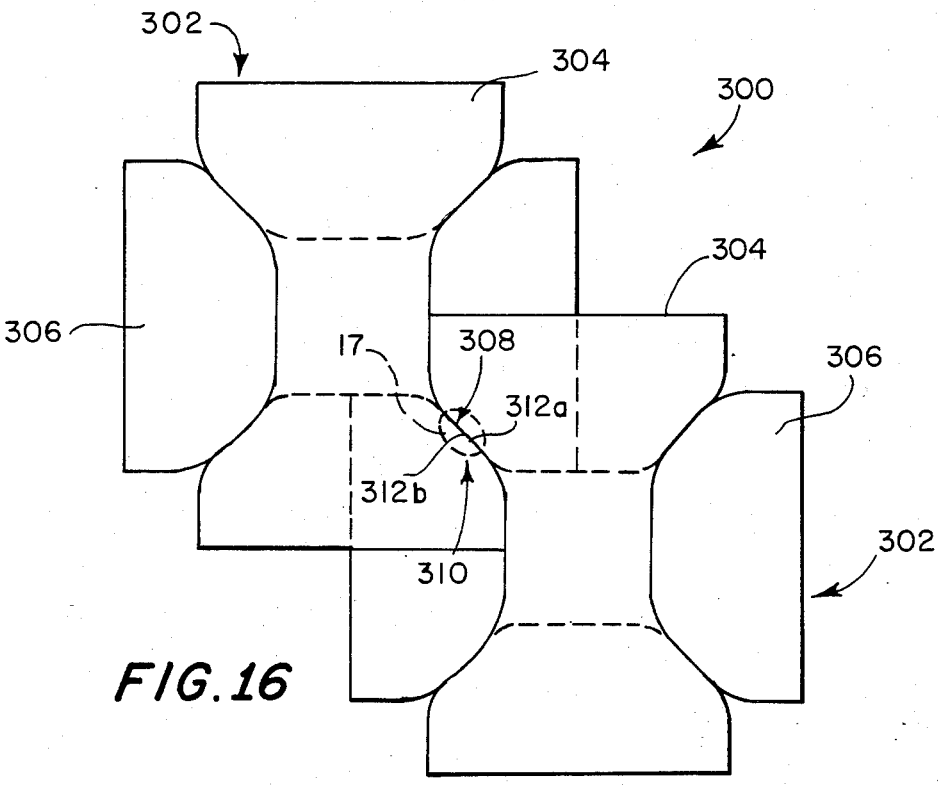
FIG. 16 is a plan view of still another embodiment of elements which are locked together.

Depicted in FIG. 16 is an alternative embodiment of a matrix 300 constructed of elements 302. As shown, each element 302 includes a first leaf 304 and a second leaf 306. Both leaves 304 and 306 are "hour glass" or "bow tie" shaped. As shown best with respect to first leaves 304 of elements 302, there is a diagonal line 308 of intersection where mating portions of first leaves 304 (and second leaves 306) of adjacent elements 302 come together. In order to lock elements 302 together, a locking means 310 is provided along each diagonal side **312*a* and 312*b* of adjacent first leaves 304**.

Figure 17:
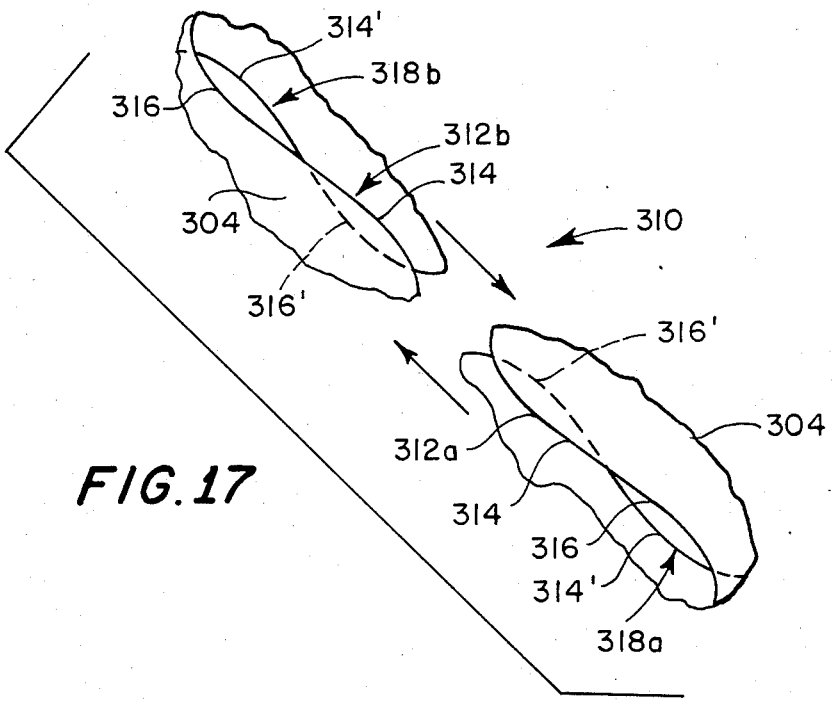
FIG. 17 is a plan view of portions of two elements depicted in FIG. 16 showing the interlocking sides.

Locking means 310 is depicted in greater detail in figure 17. FIG. 17 depicts diagonal sides **312*a* and 312*b* prior to assembly of matrix 300. As shown, diagonal sides 312*a* and 312*b* contain at least one projection 314 and at least one successive indentation 316. When fully assembled, projection 314 and indentation 316 of diagonal side 312*a* mate with a corresponding identation 316 and projection 314 of diagonal side 312*b*. This causes first leaves 304 to be locked together with one another when matrix 300 is formed. In order to form matrix 300, it should be appreciated that diagonal sides 312*a* and 312*b*** must be somewhat resilient or elastically deformable.

It should also be appreciated that adjacent second leaves 306 of elements 304 similarly include diagonal sides **318*a* and 318*b* having a projection 314' and an identation 316' which mate with each other in the same manner as diagonal sides 312*a* and 312*b*. As shown, projection 314' is located along line 308 at the same place as indentation 316, and identation 316' is located at the same place as projection 314. This provides interlocking of both first leaves 304 and second leaves 306. With this construction, it is therefore required that in order to assemble two elements 302 together, elements 302 must be moved together along a direction parallel to diagonal sides 312*a*, 312*b*, 318*a*, and 318*b* as shown by the arrows in FIG. 17**.

It should further be appreciated that a multiple number of alternating projections 314 and indentations 316 can be provided along the diagonal sides. In addition, the relatively smooth and curved projections 314 and indentations 316 can be replaced with tooth shaped projections and indentations to provide a more positive locking of elements 302 together. The depths of identations 316 and height of projections 314 can similarly be varied, depending on the resiliency or elasticity of the material from which elements 302 are constructed.

Although the present invention has been described with respect to a number of embodiments, it should be appreciated that additional embodiments are possible which comprise a new combination of selected features from the disclosed embodiments. For example, ceramic blocks could be located in a third leaf if desired. In addition, the thickness of the leaves is relatively arbitrary, and selected according to the needs of the armor to be provided.

It should also be appreciated that the present invention of interfitted elements provides a matrix which supports bending movements over a large area, even with no joining of the elements. However, any local deformation away from the impacted element is significantly reduced because the matrix is discontinuous. With an unjoined matrix of elements, the matrix maintains its inherent in-plane stiffness but does not support in-plane tensile loads. Thus, for example, tensile failure of a front leaf and back leaf cannot occur beyond the impacted element itself. In addition, each individual element represents a discontinuous structure which is inherently poor for transmission of shock to adjacent elements.

With the present invention, it is also possible to provide layers of shock damping material between mating leaves of the elements. Such a shock damping material would further isolate each individual element from an adjacent element. It should also be appreciated that certain design features on the front of the matrix of elements can be provided to further lessen collateral damage. Such design features include pre-scoring and rib stiffening.

The applications useful for the present invention are many and varied. Typically, a matrix of interleaved elements, either with or without ceramic blocks, would have applications as follows: structural and appliqué armors for flat or curved surfaces; portable bullet-proof shields; bullet-proof matting; temporary protective enclosures; and body armor.

It should also be appreciated that although cruciform elements made up of rectangular leaves have been depicted, other forms of elements which are inherently self-supporting are possible. For example, elements having an upper leaf formed of two isosceles triangles touching at their apexes so as to form a "bow tie" silhouette and a lower leaf formed of two isosceles triangles touching at their bases so as to form a diamond silhouette are possible. Similarly, a variety of parallelogram shaped leaves as well as leaves with curved edges are also possible.

Thus, the requirement of the present invention for an element which interfits with a plurality of similar elements to provide a self-supporting plane or structure is achievable with a number of different shaped elements. What is required is a first plane or leaf to which a second plane or leaf is suitably attached. When the elements are interfitted, the shape of the first leaf is required to be such that all of the first leaves of the interfitted elements form a continuous plane with the sides and ends of the first leaves having small gaps and thus being substantially continuous. Similarly, the shape of the second leaf is required to be such that the second leaves of the interfitted elements form a second continuous plane with the sides of the second leaves substantially continuous. Finally, in order for the elements to form a self-supporting plane or structure, it is also required that the shapes of the first leaves and second leaves of each element are such that portions of the bottom of the first leaf extended away from respective adjacent sides of the second leaf and portions of the bottom of the second leaf extend freely away from respective adjacent sides of the first leaf of each element. The interfitting of the plurality of elements then causes the free bottom portions of the first leaf of each element to overlay at least three other free top portions of the second leaves of adjacent elements, and the free top portions of the second leaf of each element to overlay at least three other free bottom portions of the first leaves of adjacent elements.

Where a surface of a predetermined curvature is to be covered by a matrix of elements, it is also possible to design each element to conform to this surface curvature. For example, if a cylindrical surface is to covered, each leaf of each element could be curved to precisely follow this curvature. Obviously, the radius or curvature of each face of the leaves would vary as the thickness of the element to that leaf surface would be included to provide concentric leaf surfaces.

It should further be appreciated that the interfitted elements of the present invention are also usable for various structural and other applications besides armor. For example, in constructing various structures, interfitted elements according to the present invention having a suitable facing surface could be assembled to provide various veneer walls for either interior or exterior use. Use of interfitted elements to form a temporary structure is also possible. Interfitted elements according to the present invention are also usable for various modular components, both large and small. Thus, interfitted elements could be used to form a heat absorbing structure for a solar heating system and these elements could include coolant passages in the lower leaves which are interconnected with each other. In a similar manner, elements containing electrical connections could also be provided to form a suitable electrical device. The elements of the present invention are further usable as toy building blocks and as model building blocks as well.

Thus, while the present invention has been described with respect to exemplary embodiments thereof, it will be appreciated by those of ordinary skill in the art that variations and modifications can be effected within the scope and spirit of the invention.

I claim:

1. A cruciform armor element which interfits with a plurality of similar elements to form a self-supporting armor layer, the element comprising:

a first rectangular parallelepiped leaf having a thickness, width, and a length which is substantially twice the width such that said first leaf defines a pair of ends, a pair of sides, a top and a bottom;

a second rectangular parallelepiped leaf having substantially the same width and length of said first leaf such that said second leaf defines a pair of ends, pair of sides, a top and a bottom;

at least one flat pocket formed in one of said leaves;

a block formed from a material different from said leaves which is received in said pocket; and a means for attaching said bottom of said first leaf to said top of said second leaf such that said first leaf is intermediate said ends of said second leaf and said second leaf is intermediate said ends of said first leaf.

2. An armor element as claimed in claim 1 wherein said bottom of said first leaf has a longitudinal axis which is perpendicular to a longitudinal axis of said top of said second leaf.

3. An armor element as claimed in claim 2 wherein said attaching means is the making of said first and second leaves integral with one another.

4. A self-supporting planar structure comprising:

a plurality of interfitted elements, each said element comprising (a) a first planar leaf having a thickness, a top, a bottom, sides and a planar shape;

(b) a second planar leaf having a thickness, a top, a bottom, sides and a planar shape;

(c) a means for attaching a portion of the bottom of said first leaf to a portion of the top of said second leaf;

the shape of said first leaf being such that said first leaves of the interfitted elements form a first continuous plane;

the shape of said second leaf being such that said second leaves of the interfitted elements form a second continuous plane;

the shapes of said first leaf and said second leaf being such that portions of the bottom of said first leaf extend freely away from respective adjacent sides of said second leaf and portions of the top of said second leaf extend freely away from respective adjacent sides of said first leaf;

wherein said top of said second leaf includes two surfaces portions, each said surface portion being located intermediate said first leaf and a respective said end of said second leaf and being convex shaped; and wherein said bottom of said first leaf includes two surface portions each said surface portion being located intermediate said second leaf and a respective said end of said first leaf and being convex shaped; and a means for interfitting a plurality of said elements such that the free bottom portions of said first leaf of each element overlay at least three other free top portions of said second leaves of adjacent said elements and such that the free top portions of said second leaf of each element underlie at least three other free bottom portions of said first leaves of adjacent said elements whereby the self-supporting structure is formed.

5. An armor element as claimed in claim 1 wherein there are two substantially square pockets formed in said one of said leaves which said pockets are separated by a small wall extending between said top and said bottom, and wherein there are two substantially square blocks which are respectively received in a respective one of said pockets.

6. An armor element as claimed in claim 5 wherein one said pocket includes an opening in one of said ends of said one of said leaves and the other said pocket includes an opening through one of said sides of said one of said leaves.

7. An armor element as claimed in claim 5 wherein both said leaves are identical.

8. An armor element as claimed in claim 5 wherein said first leaf contains said pockets; and further including (a) a third rectangular parallelepiped leaf having substantially the same width and length of said first leaf such that said third leaf defines a pair of ends, a pair of sides, a top, and a bottom, and (b) a means for attaching said bottom of said third leaf to said top of said first leaf such that said first leaf is intermediate said ends of said third leaf and said third leaf is intermediate said ends of said first leaf.

9. An armor element as claimed in claim 8 wherein the longitudinal axis of said third leaf is parallel to the longitudinal axis of said second leaf; and wherein said first leaf, said second leaf and said third leaf are integrally formed.

10. An armor element as claimed in claim 2 wherein said top of said second leaf includes two surface portions , each said surface portion being located intermediate said first leaf and a respective said end of said second leaf and being convex shaped; and wherein said bottom of said first leaf includes two surface portions each said surface portion being located intermediate said second leaf and a respective said end of said first leaf and being convex shaped.

11. An armor element as claimed in claim 2 and further including:

a third rectangular parallelepiped leaf having substantially the same width and length of said first leaf such that said third leaf defines a pair of ends, a pair of sides, a top, and a bottom;

a fourth rectangular parallelepiped leaf having substantially the same width and length of said first leaf such that said fourth leaf defines a pair of ends, a pair of sides, a top and a bottom; and an attaching means for attaching said top of said third leaf to said bottom of said second leaf such that said third leaf is intermediate said ends of said second leaf and said second leaf is intermediate said ends of said third leaf, and an attaching means for attaching said top of said fourth leaf to said bottom of said third leaf such that said fourth leaf is intermediate said ends of said third leaf and said third leaf is intermediate said ends of said fourth leaf.

12. A modular armor comprising:

a matrix of interfitted elements which form a self-supporting layer, each said element comprising:

(a) a first parallelepiped leaf having a thickness, a width, and a length which is substantially twice the width such that said first leaf defines a pair of ends, a pair of sides, a top and a bottom;

(b) a second parallelepiped leaf having substantially the same width and length as said first leaf such that said second leaf defines a pair of ends, a pair of sides, a top and a bottom;

(c) at least one flat pocket formed in one of said leaves and a block formed from a material different from said leaves which is received in said pocket; and (d) a means for attaching said bottom of said first leaf to said top of said second leaf such that said first leaf is intermediate said ends of said second leaf and said second leaf is intermediate said ends of said first leaf; and a means for holding said matrix of elements together as a unit with portions of the ends of said first leaf of each said element disposed over respective portions of the ends of said second leaves of adjacent said elements.

13. A modular armor as claimed in claim 12 wherein said first leaf and said second leaf have a rectangular cross section and wherein said bottom of said first leaf has a longitudinal axis which is perpendicular to a longitudinal axis of said top of said second leaf.

14. A modular armor as claimed in claim 13 wherein said attaching means is the making of said first and second leaves integral with one another.

15. A self-supporting planar structure comprising:

a plurality of interfitted elements, each said element comprising (a) a first planar leaf having a thickness, a top, a bottom, sides and a longitudinal planar shape;

(b) a second planar leaf having a thickness, a top, a bottom, sides and a longitudinal planar shape;

(c) a means for attaching a portion of the bottom of said leaf to a portion of the top of said leaf;

the shape of said first leaf being such that said first leaves of the interfitted elements form a first continuous plane with the sides of said first leaves contiguous;

the shape of said second leaf being such that said second leaves of the interfitted elements form a second continuous plane with the sides of said second leaves contiguous;

the shapes of said first leaf and said second leaf being such that portions of the bottom of said first leaf extend freely away from respective adjacent sides of said second leaf and portions of the bottom of said second leaf extend freely away from respective adjacent sides of said first leaf;

(d) a pair of diagonal side portions on each of said sides of each leaf, each said diagonal portion of said pair being located adjacent a respective said portion of said leaf extending freely away from adjacent sides of the other said leaf; and (e) a lock means for locking contiguous said diagonal portions of adjacent said elements together, said lock means including a lock projection on each diagonal side which is capable of being slid past a corresponding said lock projection on an adjacent leaf during assembly of the matrix; and a means for interfitting a plurality of said elements such that the free bottom portions of said first leaf of each element overlay at least three other free top portions of said second leaves of adjacent said elements and such that the free top portions of said second leaf of each element underlie at least three other free bottom portions of said first leaves of adjacent said elements whereby the self-supporting structure is formed.

16. A modular armor as claimed in claim 12 wherein there are two substantially square pockets formed in said one of said leaves which said pockets are separated by a small wall extending between said top and said bottom, and wherein there are two substantially square blocks which are respectively received in a respective one of said pockets.

17. A modular armor as claimed in claim 16 wherein one said pocket includes an opening in one of said ends of said one of said leaves and the other said pocket includes an opening through one of said sides of said one of said leaves.

18. A modular armor as claimed in claim 17 wherein both said leaves are identical.

19. A modular armor as claimed in claim 16 wherein said blocks are made of a ceramic material.

20. A modular armor as claimed in claim 19 wherein said first leaf contains said pockets; and further including (a) a third rectangular parallelepiped leaf having substantially the same width and length of said first leaf such that said third leaf defines a pair of ends, a pair of sides, a top, and a bottom, and (b) a means for attaching said bottom of said third leaf to said top of said first leaf such that said first leaf is intermediate said ends of said third leaf and said third leaf is intermediate said ends of said first leaf.

21. A modular armor as claimed in claim 20 wherein said bottom of said third leaf has a longitudinal axis which is parallel to a longitudinal axis of said top of said first leaf; and wherein said first leaf, said second leaf and said third leaf are integrally formed.

22. A modular armor as claimed in claim 21 wherein said holding means is a weld between adjacent elements along adjacent third leaves and along adjacent second leaves.

23. A modular armor as claimed in claim 21 wherein said holding means includes a lock means for releasably locking one said element to adjacent said elements.

24. A modular armor as claimed in claim 22 wherein said lock means includes: a lock projection on one of (a) said top and said bottom of said first leaf and (b) said top of said second leaf and said bottom of said third leaf; and a lock indentation on the other of (a) said top and said bottom of said first leaf and (b) said top of said second leaf and said bottom of said third leaf.

25. A modular armor as claimed in claim 21 wherein said holding means is a frictional fit between adjacent interfitted elements provided by the overlapping portions of (a) said top and said bottom of said first leaf of one said element and (b) said top of said second leaf and said bottom of said third leaf of adjacent said elements.

26. A modular armor as claimed in claim 14 wherein said holding means is a lock means for releasably locking one said element to adjacent said elements.

27. A modular armor as claimed in claim 26 wherein said lock means includes a lock projection on one of said bottom of said first leaf and said top of said second leaf, and a lock indentation on the other of said bottom of said first leaf and said top of said second leaf.

28. A modular armor as claimed in claim 26 wherein said first and said second leaves include diagonal sides which form substantially a planar surface, and wherein both of said diagonal sides of said first and said second leaves include a lock projection and a lock indentation which mate with a similarly formed respective said lock projection and said lock indentation on an adjacent said diagonal side of an adjacent said element to lock said elements together.

29. A modular armor as claimed in claim 28 wherein said lock projection on said diagonal side of said first leaf is immediately adjacent to said lock indentation on said diagonal side of said second leaf, and said lock indentation on said diagonal side of said first leaf is immediately adjacent to said lock projection on said diagonal side of said second leaf.

30. A modular armor as claimed in claim 14 wherein said holding means is a frictional fit between adjacent interfitted elements provided by the overlapping portions of said bottom of said first leaf and said top of said second leaf.

31. A modular armor as claimed in claim 14 wherein said holding means includes a continuous layer and an attaching means for attaching a plurality of said elements to said layer.

32. A modular armor as claimed in claim 14 wherein said holding means is a thin layer of bonding material located on facing surfaces of said interfitted leaves.

33. A modular armor as claimed in claim 14 wherein said holding means is a weld between adjacent elements.

34. A modular armor as claimed in claim 14 wherein said holding means is a frame containing said matrix.

35. A modular armor as claimed in claim 34 wherein said frame has a plurality of sides with an interior portion configured to interfit with an outer row of said matrix of interfitted said elements.

36. A modular armor as claimed in claim 35 wherein said outer row extends parallel to the longitudinal axes of ones of said leaves of the respective said elements of the row.

37. A modular armor as claimed in claim 35 wherein said outer row extends at substantially 45° to the longitudinal axes of ones of said leaves of the respective said elements of the row.

38. A modular armor as claimed in claim 35 and further including an attaching means for attaching said frame to an underlying structure.

39. A modular armor as claimed in claim 14 wherein said top of said second leaf includes two surface portions, each said surface portion being located intermediate a respective said end of said second leaf and said first leaf, and being convex shaped; and wherein said bottom of said first leaf includes two surface portions, each said surface portion being located intermediate a respective said end of said first leaf and said second leaf, and being convex shaped.

40. A modular armor as claimed in claim 39 wherein said holding means includes a layer of flexible material and a means for attaching each element to said layer.

41. A modular armor as claimed in claim 14 and further including:

a third rectangular parallelepiped leaf having substantially the same width and length of said first leaf such that said third leaf defines a pair of ends, a pair of sides, a top, and a bottom;

a fourth rectangular parallelepiped leaf having substantially the same width and length of said first leaf such that said third leaf defines a pair of ends, a pair of sides, a top and a bottom; and an attaching means for attaching said top of said third leaf to said bottom of said second leaf such that said third leaf is intermediate said ends of said second leaf and said second leaf is intermediate said ends of said third leaf, and an attaching means for attaching said top of said fourth leaf to said bottom of said third leaf such that said fourth leaf is intermediate said ends of said third leaf and said third leaf is intermediate said ends of said fourth leaf.

42. A modular armor as claimed in claim 41 wherein said holding means is a localized deformation of a plurality of the interfitted leaves of two adjacent said elements.

43. A modular armor as claimed in claim 14 wherein said holding means includes a tongue and groove means for interfitting one element with an adjacent element.

44. A modular armor as claimed in claim 43 wherein said tongue and groove means includes a respective tongue having a V pattern in plan view provided at each said end on one of said bottom of said first leaf and said top of said second leaf, and a respective groove having a corresponding V pattern in plan view provided at each said end on the other of said bottom of said first leaf and said top of said second leaf, and wherein the tips of said V pattern of said tongues and grooves are located adjacent the respective corners of respective said ends.

45. A self-supporting planar structure comprising:

a plurality of interfitted elements, each said element comprising (a) a first planar leaf having a thickness, a top, a bottom, sides and a planar shape;

(b) a second planar leaf having a thickness, a top, a bottom, sides and a planar shape;

(c) a means for attaching a portion of the bottom of said first leaf to a portion of the top of said second leaf;

(d) at least one flat pocket formed in one of said leaves and a discrete insert which is received in said pocket;

the shape of said first leaf being such that said first leaves of the interfitted elements form a first continuous plane;

the shape of said second leaf being such that said second leaves of the interfitted elements from a second continuous plane; and the shapes of said first leaf and said second leaf being such that portions of the bottom of said first leaf extend freely away form respective adjacent sides of said second leaf and portions of the top of said second leaf extend freely away from respective adjacent sides of said first leaf; and a means for interfitting a plurality of said elements such that the free bottom portions of said first leaf of each element overlay at least three other free top portions of said second leaves of adjacent said elements and such that the free top portions of said second leaf of each element underlie at least three other free bottom portions of said first leaves of adjacent said elements whereby the self-supporting structure is formed.

46. A self-supporting planar structure as claimed in claim 45 wherein there are two substantially square pockets formed in said one of said leaves which said pockets are separated by a small wall extending between said top and said bottom, and wherein there are two substantially square inserts which are respectively received in a respective one of said pockets.

47. A self-supporting planar structure as claimed in claim 45 and further including (a) a third rectangular planar leaf having substantially the same shape of said first leaf such that said third leaf has a top, a bottom, and sides, and (b) a means for attaching said bottom of said third leaf to said top of said first leaf such that portions of the top of said first leaf extend freely away from respective adjacent sides of said third leaf and portions of the bottom of said third leaf extend freely away from respective adjacent sides of said first leaf.

48. A self-supporting planar structure as claimed in claim 45 and further including a lock means for releasably locking each said element to adjacent said elements.

49. A self-supporting planar structure as claimed in claim 45 wherein said portions of said bottom of said first leaf and said portions of the top of said second leaf are convex shaped;

50. A self-supporting planar structure comprising:

a plurality of interfitted elements, each said element comprising (a) a first planar leaf having a thickness, a top, a bottom, sides and a planar shape;

(b) a second planar leaf having a thickness, a top, a bottom, sides and a planar shape;

(c) a third planar leaf having a thickness, a top, a bottom, and sides;

(d) a first attaching means for attaching a portion of the bottom of said first leaf to a portion of the top of said second leaf such that said second leaf is intermediate opposed free ends of said first leaf and said first leaf is intermediate opposed free ends of said second leaf;

(e) a second attaching means for attaching a portion of said top of said third leaf to a portion of said bottom of said second leaf such that said third leaf is intermediate opposed free ends of said second leaf and said second leaf is intermediate opposed free ends of said third leaf;

the shape of said first leaf being such that said first leaves of the interfitted elements form a first continuous plane; and the shape of said second leaf being such that said second leaves of the interfitted elements form a second continuous plane; and a means for interfitting a plurality of said elements such that the free ends of said first leaf of each element overlay at least three other free ends of said second leaves of adjacent said elements, such that the free ends of said second leaf of each element underlie at least three other free ends of said first leaves of adjacent said elements and at least three other free ends of said third leaves of adjacent said elements, and such that the free ends of said third leaf of each element overly at least three free ends of said second leaves of adjacent said elements whereby the self-supporting structure is formed.

51. A self-supporting planar structure as claimed in claim 50 and further including a lock means for releasably locking each said element to adjacent said elements.

52. A self-supporting planar structure as claimed in claim 51 wherein said locking means is a frictional fit between adjacent interfitted elements provided by the overlapping portions of (a) said top and said bottom of said second leaf of one said element and (b) said top of said third leaf and said bottom of said first leaf of adjacent said elements.

53. A self-supporting planar structure comprising:

a plurality of interfitted elements, each said element comprising (a) a first planar leaf having a thickness, a top, a bottom, sides and a planar shape;

(b) a second planar leaf having a thickness, a top, a bottom, sides and a planar shape;

(c) a means for attaching a portion of the bottom of said first leaf to a portion of the top of said second leaf;

the shape of said first leaf being such that said first leaves of the interfitted elements form a first continuous plane;

the shapes of said second leaf being such that said second leaves of the interfitted elements form a second continuous plane;

the shapes of said first leaf and said second leaf being such that portions of the bottom of said first leaf extend freely away from respective adjacent sides of said second leaf and portions of the top of said second leaf extend freely away from respective adjacent sides of said first leaf; and (d) a lock means for locking on said element to all adjacent said elements as said element is moved parallel to said continuous planes, said lock means including at least one lock projection provided on one of said bottom portions of said first leaf and said top portions of said second leaf and a corresponding lock indentation provided on the other of said bottom portions of said first leaf and said top portions of said second leaf; and a means for interfitting a plurality of said elements such that the free bottom portions of said first leaf of each element overlay at least three other free top portions of said second leaves of adjacent said elements and such that the free top portions of said second leaf of each element underlie at least three other free bottom portions of said first leaves of adjacent said elements whereby the self-supporting structure is formed.

54. A self-supporting planar structure as claimed in claim 53 wherein said lock projections have a V pattern in plan view and said lock indentations have a V pattern in plan view such that one element is locked to another by a movement parallel to a leg of one of said interfitting V patterns.

* * * * *